US008122829B2

(12) United States Patent
Riviere et al.

(10) Patent No.: US 8,122,829 B2
(45) Date of Patent: Feb. 28, 2012

(54) SAFETY LIGHTER FOR PYROTECHNIC DEVICE

(75) Inventors: Christophe Riviere, Olivet (FR); Patrick Cohe, Neuvy En Sullias (FR); Alain Dousset, Ingre (FR)

(73) Assignee: TDA Armements SAS, La Ferte Saint Aubin (FR)

( * ) Notice: Subject to any disclaimer, the term of this patent is extended or adjusted under 35 U.S.C. 154(b) by 124 days.

(21) Appl. No.: 12/305,111

(22) PCT Filed: Jun. 14, 2007

(86) PCT No.: PCT/EP2007/055876
§ 371 (c)(1),
(2), (4) Date: Feb. 12, 2009

(87) PCT Pub. No.: WO2007/144396
PCT Pub. Date: Dec. 21, 2007

(65) Prior Publication Data

US 2009/0320709 A1 Dec. 31, 2009

(30) Foreign Application Priority Data

Jun. 16, 2006 (FR) ..... 06 04816

(51) Int. Cl.
*F42C 15/184* (2006.01)

(52) U.S. Cl. ..... 102/254; 102/229; 102/275.11

(58) Field of Classification Search ..... 102/251, 102/254, 255, 256, 229, 275.11
See application file for complete search history.

(56) References Cited

U.S. PATENT DOCUMENTS

| | | | | |
|---|---|---|---|---|
| 3,195,460 | A | 7/1965 | Kalaf | |
| 3,511,183 | A | 5/1970 | Geffner | |
| 3,630,152 | A * | 12/1971 | Arnell | 102/256 |
| 4,006,689 | A * | 2/1977 | Bastide | 102/226 |
| 5,131,328 | A * | 7/1992 | Chan | 102/229 |
| 6,792,868 | B2 | 9/2004 | Teilhol et al. | |

FOREIGN PATENT DOCUMENTS

WO WO-01/77608 A 10/2001

* cited by examiner

*Primary Examiner* — Stephen M Johnson
(74) *Attorney, Agent, or Firm* — Stroock & Stroock & Lavan LLP

(57) ABSTRACT

Embodiments of the invention relate to a safety lighter intended to initiate the combustion of a pyrotechnic device, the lighter including a lighter body (10) having a cylindrical void (12) of axis XX', and a pyrotechnic slide-in module (14) including pyrotechnic means (70, 74, 30) of initiating the combustion of the pyrotechnic device, the pyrotechnic slide-in module (14) being able to be displaced in the cylindrical void, from a so-called safety position (Ps), providing isolation between the pyrotechnic means of the slide-in module and the pyrotechnic device to be initiated, to a so-called initiation position (Pi), intended to provoke the combustion of the pyrotechnic device.

14 Claims, 3 Drawing Sheets

SAFETY LIGHTER FOR PYROTECHNIC DEVICE

CROSS-REFERENCE TO PRIOR APPLICATION

This is a U.S. National Phase Application under 35 U.S.C. §371 of International Application No. PCT/EP07/055876, filed Jun. 14, 2007 and claims benefit of French Patent Application No. 06/04816, filed on Jun. 16, 2006 both of which are incorporated herein. The International Application was published in French on Dec. 21, 2007 as WO 2007/144396 under PCT Article 21(2).

FIELD OF THE INVENTION

The present invention relates to a safety lighter to initiate the combustion of any type of pyrotechnic device after a determined delay time, such as, for example, the pyrotechnic engines of missiles lit at a safe distance.

BACKGROUND OF THE INVENTION

The pyrotechnic initiator, the first component of the pyrotechnic lighting chain, can be activated by various means such as electrical, mechanical, thermal, optical means. These means provide stimuli, more often than not of low amplitude, to activate the initiator. These stimuli, which can be in the normal or accidental environment of the pyrotechnic device, can inopportunely activate the lighter provoking the nominal operation of the pyrotechnic device.

The regulations concerning the ignition of pyrotechnic lighting devices, notably missiles, are constantly changing toward greater safety, for example by the application of NATO standards.

The main safety criterion is that the pyrotechnic device should not be triggered inopportunely. An uncontrolled triggering can involve serious risks to personnel and significant equipment damage.

To avoid the effects of inopportune triggerings, the lighters of the prior art whose lighting chain contains sensitive pyrotechnic compounds, normally comprise a safety switch, for example toggle, slider, rotor, which separates these sensitive compounds from the rest of the pyrotechnic chain, and which can be opened when the lighter is deliberately operated only by the activation of at least one safety device.

Ignition delays are often introduced into the lighters according to parameters associated with the use of the pyrotechnic device, for example to ensure a sufficient safety distance relative to the personnel and equipment to be protected.

These ignition delays can easily be obtained and managed by an electronic circuit receiving an activation signal and supplying an electrical signal delayed by a time t predetermined according to the use of the pyrotechnic device. Such electronic activation-delay generating devices require an electrical energy source and occupy a volume that is sometimes incompatible with the available bulk constraints for certain applications.

SUMMARY OF THE INVENTION

In order to overcome the drawbacks of the lighters of the prior art, embodiments of the invention propose a safety lighter intended to initiate the combustion of a pyrotechnic device, characterized in that it comprises:

- a lighter body having a cylindrical void of axis XX';
- a pyrotechnic slide-in module comprising pyrotechnic means of initiating the combustion of the pyrotechnic device, the pyrotechnic slide-in module being able to be displaced in the cylindrical void of the lighter body from a so-called safety position, providing isolation between the pyrotechnic means of the slide-in module and the pyrotechnic device to be initiated, to a so-called initiation position, intended to provoke the combustion of the pyrotechnic device;
- sealing means between the pyrotechnic slide-in module and the lighter body to isolate, in the safety position, the pyrotechnic slide-in module from the pyrotechnic device to be initiated;
- mechanical means for maintaining the pyrotechnic slide-in module in the safety position.

Advantageously, the pyrotechnic means of the pyrotechnic slide-in module comprise an igniter, a pyrotechnic delay initiated by the igniter and an intermediate lighting relay initiated by the pyrotechnic delay.

In another embodiment, the safety lighter comprises an output lighting relay initiated by the intermediate lighting relay.

A main objective of the invention is to obtain pyrotechnic lighters that have a greater operating safety and reliability.

Another objective is to produce compact lighters compatible with pyrotechnic devices that have only little space for the lighter.

Another objective is to reduce the costs of such pyrotechnic lighters by reducing the number of components needed for their operation.

BRIEF DESCRIPTION OF DRAWINGS

The invention will be better understood using exemplary embodiments of the lighter according to the invention, with reference to the indexed drawings in which.

DETAILED DESCRIPTION OF EMBODIMENTS

Figure 1:
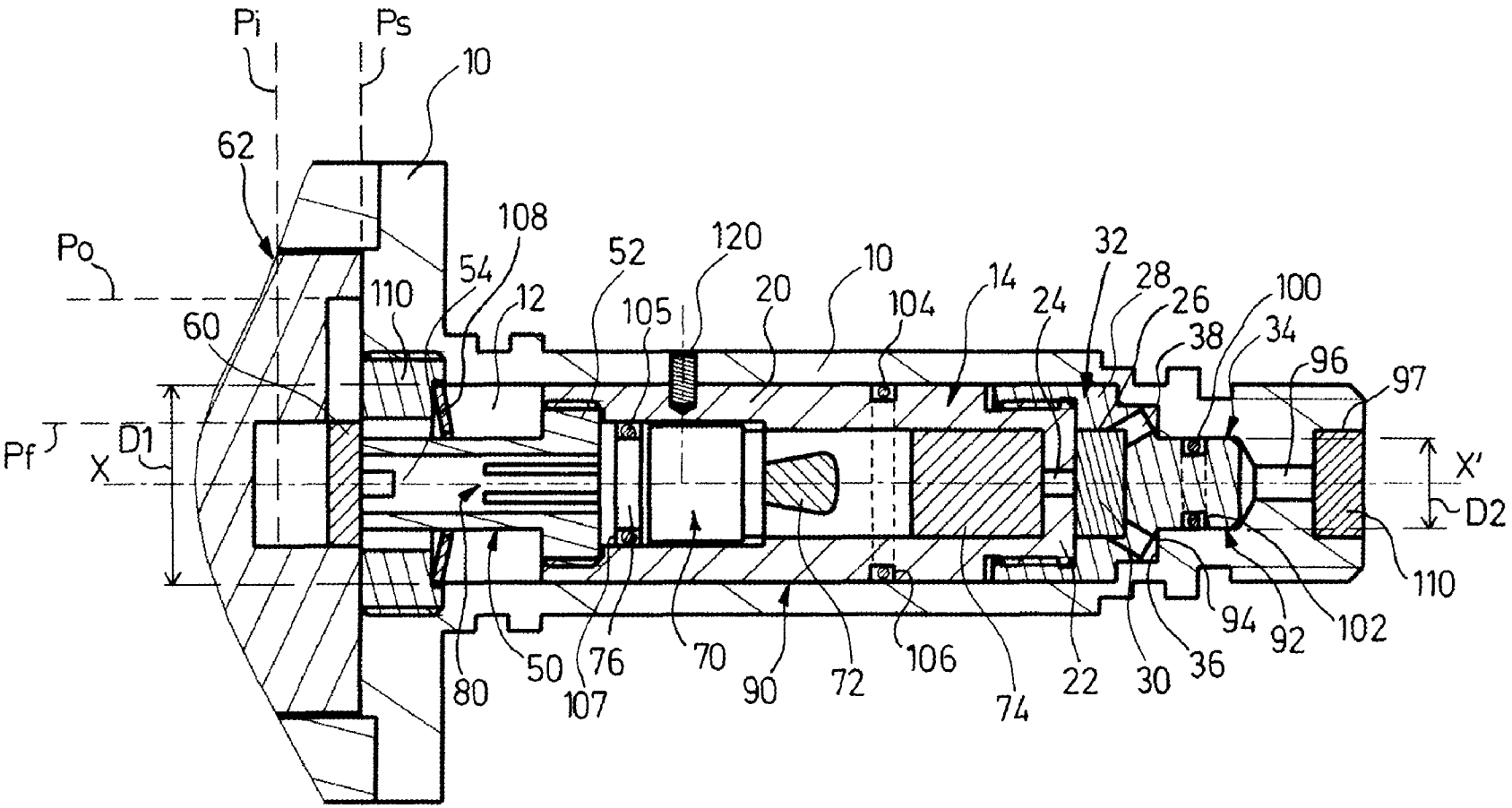
FIGS. 1, 2 and 3 represent an exemplary embodiment of a safety lighter according to the invention.

The lighter of FIG. 1 comprises a lighter body 10 having a cylindrical void 12 of axis XX', into which a pyrotechnic slide-in module 14 can slide.

The pyrotechnic slide-in module 14 can be displaced in the cylindrical void 12 of the lighter body 10, from a so-called safety position Ps, providing isolation between the pyrotechnic means of the lighter and the pyrotechnic device, to a so-called initiation position Pi, to provoke the initiation of the combustion of the pyrotechnic device (not represented in the figures).

The pyrotechnic slide-in module 14 comprises a pyrotechnic chamber 20 in tube form closed at one of the ends by a closure wall 22 perpendicular to the axis XX' comprising a first hole 24 for passage of the gases between the pyrotechnic chamber 20 and a cell 26 of a cap 28 for closing the pyrotechnic chamber 20. The cell 26 of the cap 28 includes an intermediate lighting relay 30 that can be activated by hot gases originating from the pyrotechnic chamber 20 through the first hole 24 for passage of the gases.

The closure cap 28 comprises two opposite ends of cylindrical form, a first end 32 in tube form, of the same diameter D1 as that of the pyrotechnic chamber 20, joined to the end of the pyrotechnic chamber comprising the closure wall 22 and a second cylindrical end 34 of smaller diameter D2 than the first. The connection between the two ends 32, 34 of different diameters D1 and D2 of the cap 28 forms at least one shoulder 36 of the cap.

Second holes 38 for passage of the gases pass through the cylindrical walls of the cap 28 opening out on one side into the cell 26 of the cap and on the other side level with the shoulder 36 of the cap.

The pyrotechnic slide-in module 14 is closed at its other end opposite to the end comprising the cap 28, by an end-stop 50 in tube form comprising a first end 52 of the end-stop joined to the pyrotechnic chamber 20 and a second end 54 of the end-stop intended to bear on an element 60 of a safety lock 62 to prevent the displacement of the pyrotechnic slide-in module 14 in the lighter body 10, from the safety position Ps to the initiation position Pi.

The pyrotechnic chamber 20, in tube form, closed at one end by the closure wall 22 and at the other end by the end-stop 50, comprises, inside the tube, on the side of the end-stop 50, an electrically-controlled igniter 70 and, facing the igniter 70, against the closure wall 22 of the pyrotechnic chamber 20, a pyrotechnic delay 74.

The igniter 70, inside the pyrotechnic chamber 20, comprises an active part 72 facing the pyrotechnic delay 74 and a hermetic bushing 76 in contact with the end-stop 50 hermetically closing the pyrotechnic chamber. The hermetic bushing 76 comprises two electrical contacts 80 to supply an electric current to activate the igniter 70.

The cylindrical void 12 of the lighter body 10 comprises a first cylindrical area 90 of the same diameter D1 as the diameter of the pyrotechnic chamber 20 enabling the pyrotechnic slide-in module to slide inside the lighter body 10, and a second cylindrical area 92 of the same diameter D2 as the diameter of the second end 34 of the cap 28. The two cylindrical areas 90, 92 of the lighter body are connected by a shoulder 94 of the lighter body.

The lighter body 10 comprises, at the end of the second cylindrical area 92, a third hole 96 opening out into another cell 97 of the lighter body 10, this other cell 97 being open toward the charge of the pyrotechnic device to be initiated.

The lighter comprises a damper 108 in washer form positioned between the cylindrical surface of the end-stop 50 and a fixed cylindrical end-stop 110 joined to the lighter body 10 on the axis XX'. The damper 108 can, for example, be a spring, an elastomer washer, or similar.

In a variant of the safety lighter, the other cell 97 of the lighter body 10 comprises an output lighting relay 110 intended to initiate the combustion of the charge of the pyrotechnic device.

The igniter 70, the pyrotechnic delay 74 and the intermediate lighting relay 30 are positioned in a closed volume comprising the pyrotechnic chamber 20, the hermetic bushing 76, the cap 28 and the lighter body 10, its seal-tightness being ensured by three o-ring seals:

a first o-ring seal 100 in a circular groove 102 around the second cylindrical end 34 of diameter D2 of the cap 28 in contact with the lighter body 10;

a second o-ring seal 104 in a circular groove 106 around the pyrotechnic chamber 20 in contact with the lighter body 10;

a third o-ring seal 105 in a circular groove 107 around the hermetic bushing 76.

The element 60 of the safety lock 62 can be fixed by control means of the lock, either in a closed position Pf preventing the passage of the mobile chamber from the safety position Ps to the initiation position Pi, or in an open position Po allowing the passage of the pyrotechnic slide-in module 14 from the safety position Ps to the initiation position Pi.

The safety lighter comprises another means of maintaining the slide-in module 14 in the safety position Ps comprising a shearable pin 120 joined by one of its ends to the lighter body 10 and by the other end to the pyrotechnic slide-in module 14.

Figure 2:
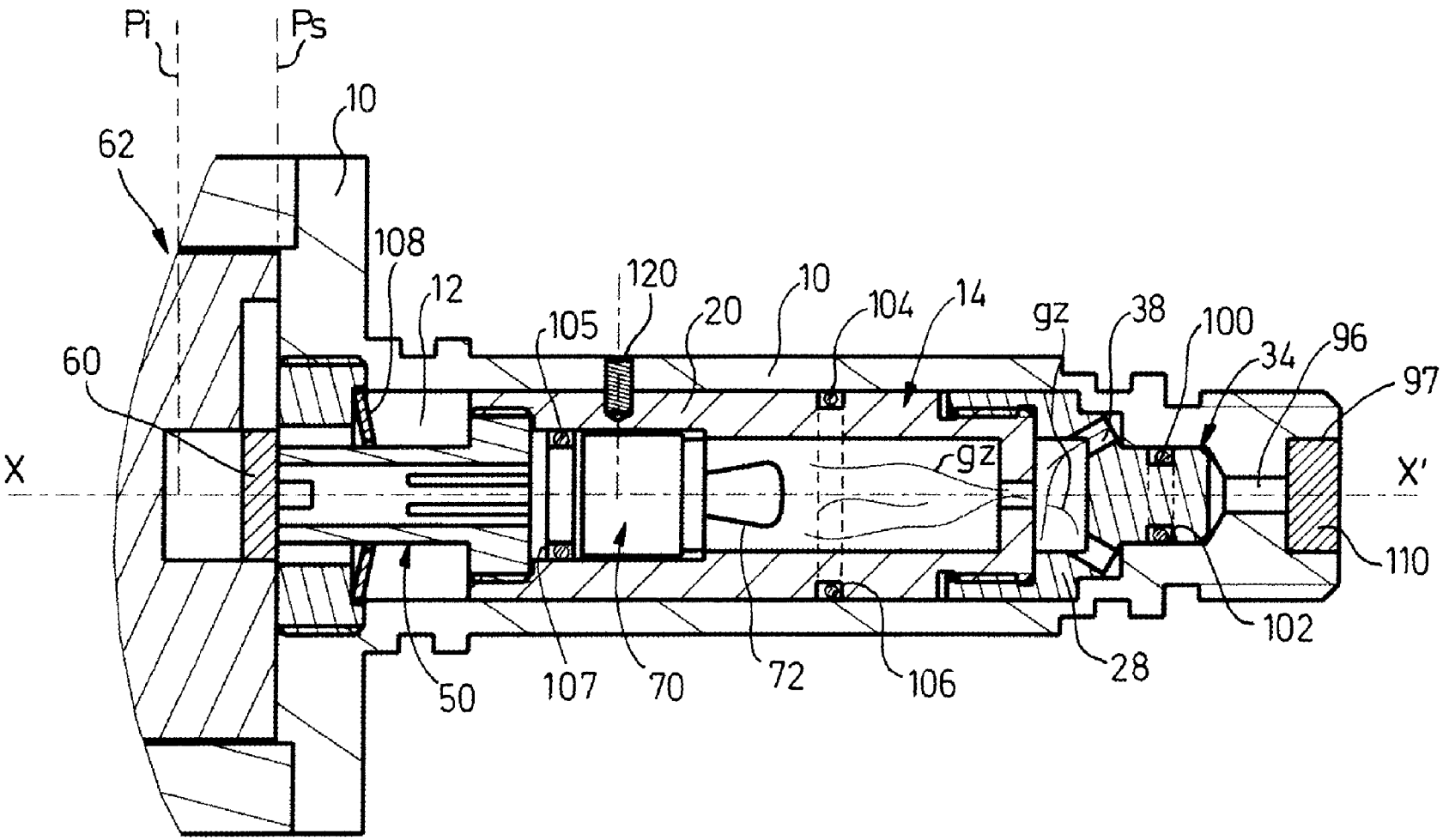
Figure 3:
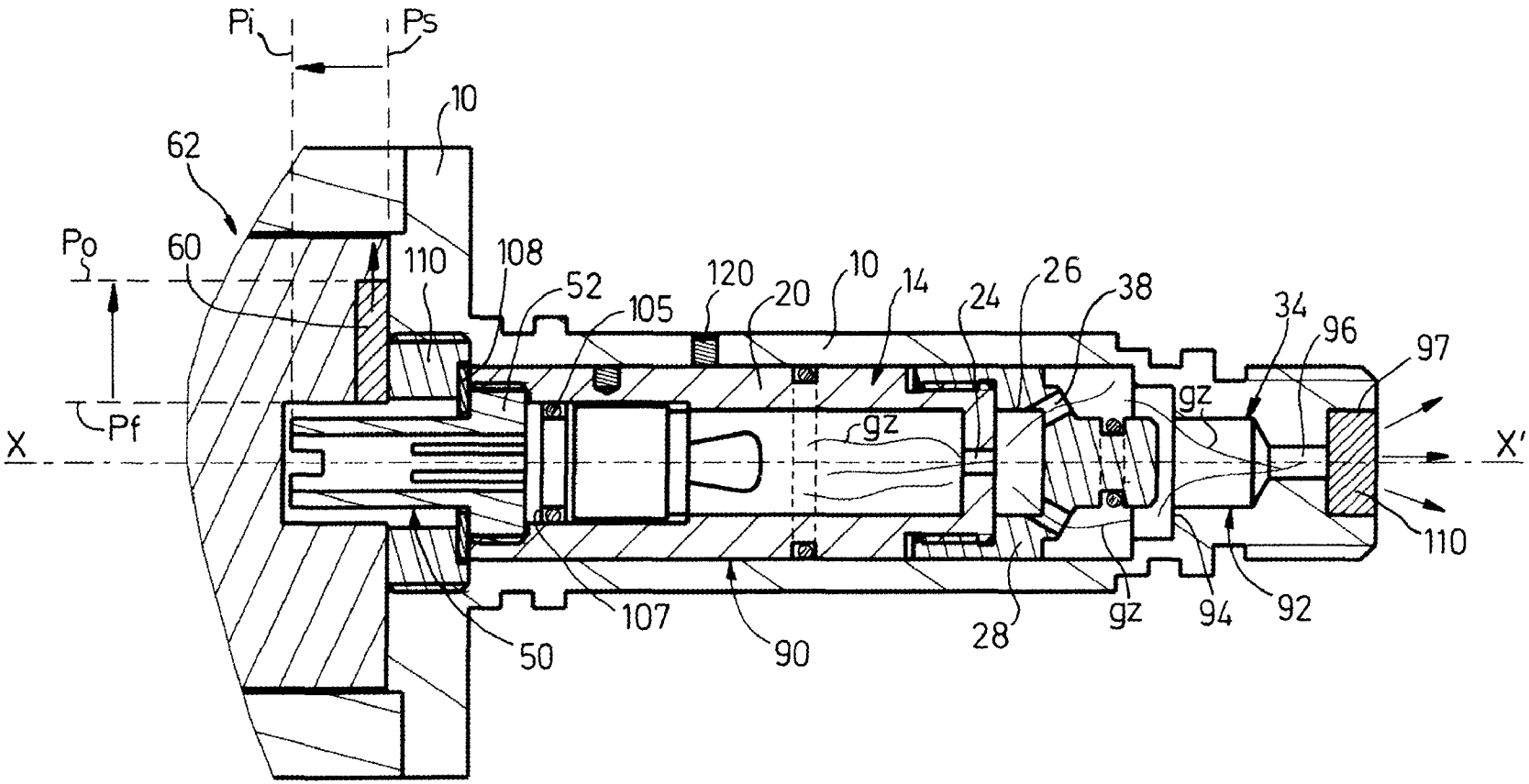

There now follows an explanation of how the lighter works with the help of FIGS. 1 to 3 in different configurations.

Storage configuration, represented in FIG. 1 (or in the so-called safety position).

In this safety configuration, the pyrotechnic chain is said to be disaligned. The pyrotechnic slide-in module 14 comprising the initiation chain is isolated from the output lighting relay 110 and from the pyrotechnic device, for example the lighting charge of a thruster, thanks to the o-ring seal 100.

The pyrotechnic slide-in module 14 is maintained in the safety position Ps in the lighter body 10 by the shearable pin 120 and the mechanical element 60 of the safety lock 62 in the closed position Pf.

Inopportune lighting configuration represented in FIG. 2.

The slide-in module is in the so-called safety position Ps.

In case of untimely initiation of the igniter 72, of the pyrotechnic delay 74 or of the intermediate lighting relay 30 of the initiation pyrotechnic chain, the pyrotechnic slide-in module can be displaced (or retracted) in the lighter body 10 under the effect of the combustion gases from the pyrotechnic delay and/or from the intermediate lighting relay 30 only to bear on the mechanical element 60 of the safety lock 62.

The pyrotechnic chain is still disaligned, the hot gases gz obtained from the combustion of the initiation chain remain contained in the pyrotechnic slide-in module 14 and in the areas of the lighter isolated from the pyrotechnic device by the seal 100. No hot gas can activate the pyrotechnic device to be initiated or the output pyrotechnic relay 110.

Normal (intentional) lighting configuration represented in FIG. 3.

When the control device of the safety lock 62 detects the specific event or events that allow the pyrotechnic device, for example a thruster, to be lit, it unblocks and clears the safety lock 62 that ensures the safety of the lighter. The mechanical element 60 of the lock passes from the closed position Pf to the open position Po.

Simultaneously, an electrical signal activates the igniter 72 which lights the pyrotechnic delay 74 in the slide-in module 14.

On completion of its combustion, after a predetermined time t, the pyrotechnic delay 74 lights the intermediate lighting relay 30 by the hot gases passing through the first hole 24 from the pyrotechnic chamber to the cell 26.

The hot gases produced by the combustion of the intermediate lighting relay 30 pass through the second holes 38 of the cap 28 from the pyrotechnic chamber to the lighter body 10 causing the pyrotechnic slide-in module 14 to retract in the lighter body 10 under the pressure of the hot gases gz.

The pyrotechnic slide-in module 14 is no longer prevented in its movement by the mechanical element 60 of the safety lock 62, so it is freed from the safety position Ps to the initiation position Pi after having sheared the pin 120 until it bears on the fixed end-stop 110. The damper 108 mitigates the effect of the impact of the pyrotechnic slide-in module 14 on the fixed end-stop 110 joined to the lighter body 10.

The hot gases gz produced by the intermediate lighting relay 30 pass through the holes for passage of the gases 38 to the second cylindrical area 92 of the lighter body 10 and initiate the output lighting relay 110 in the other cell 97 and finally the charge of the pyrotechnic device to be initiated (thruster for example).

One main benefit of the invention is to obtain pyrotechnic lighters that have a far greater safety and reliability and allow for risk-free storage. In the case where the lighter is mounted in a pyrotechnic device, the inopportune lighting of the pyrotechnic chain does not cause the charge of the pyrotechnic device to be accidentally lit.

The safety lighter according to the invention can be used for numerous civilian or military applications, such as, for example, for lighting rockets, missile engines, gas generators for pressurizing tanks, pyromechanisms such as apogee motor initiators or squibs.

The invention claimed is:

1. A safety lighter to initiate combustion comprising:

an output lighting relay;

a lighter body having a cylindrical void along an axis;

a pyrotechnic slide-in module comprising an igniter for initiating combustion of the output lighting relay, the pyrotechnic slide-in module being able to be displaced in the cylindrical void from a safety position (Ps), providing isolation between the pyrotechnic initiator and the output lighting relay, to an initiation position (Pi) configured to initiate combustion of the output lighting relay;

a first o-ring seal between the pyrotechnic slide-in module and the lighter body to isolate, in the safety position (Ps), the pyrotechnic slide-in module from the output lighting relay to be initiated; and a retaining mechanism to maintain the pyrotechnic slide-in module in the safety position (Ps), wherein the pyrotechnic slide-in module comprises:

a tubular pyrotechnic chamber having a first end and a second end, the tubular pyrotechnic chamber comprising the igniter and a pyrotechnic delay initiated by the igniter;

a closure wall, perpendicular to the axis, closing the first end of the pyrotechnic chamber, the closure wall having a first hole, wherein gases pass from the tubular pyrotechnic chamber to a cell of a cap configured to close the first hole.

2. The safety lighter as claimed in claim 1, wherein the pyrotechnic initiator comprises the igniter, the pyrotechnic delay initiated by the igniter and an intermediate lighting relay initiated by the pyrotechnic delay.

3. The safety lighter as claimed in claim 1, wherein the cell includes an intermediate lighting relay that can be activated by hot gases originating from the tubular pyrotechnic chamber through the first hole.

4. The safety lighter as claimed in claim 1, wherein the cap comprises:

a first cylindrical end having a diameter D1 approximately equal to a diameter of the tubular pyrotechnic chamber, the first cylindrical end joined to the closure wall;

a second cylindrical end of a diameter D2 smaller than diameter D1; and a shoulder connecting the first cylindrical end and the second cylindrical end, wherein the shoulder is configured to have a second hole for passage of gases from the cell, through the cap.

5. The safety lighter as claimed in claim 1, wherein the pyrotechnic slide-in module is closed at the second end by a tubular end-stop, the tubular end-stop comprising:

a first end-stop end joined to the tubular pyrotechnic chamber and a second end-stop end bearing on the retaining mechanism to maintain the pyrotechnic slide-in module, to prevent the displacement of the pyrotechnic slide-in module from the safety position (Ps) to the initiation position (Pi).

6. The safety lighter as claimed in claim 5, comprising:

a damper comprising a washer, positioned between the cylindrical surface of the end-stop and a fixed cylindrical end-stop joined to the lighter body on the axis.

7. The safety lighter as claimed in claim 5, wherein the tubular pyrotechnic chamber comprises:

the igniter configured inside the tubular pyrotechnic chamber, proximate to the tubular end-stop; and a pyrotechnic relay, facing the electrically-controlled igniter, against the closure wall of the chamber.

8. The safety lighter as claimed in claim 7, wherein the lighter body comprises, at the end of the second cylindrical area, a third hole opening out into a second cell of the lighter body, the second cell being open toward a charge of the output lighting relay to be initiated.

9. The safety lighter as claimed in claim 8, wherein the second cell of the lighter body comprises an output lighting relay configured to initiate the combustion of the charge of the igniter.

10. The safety lighter as claimed in claim 7, wherein the electrically-controlled igniter comprises:

an active part facing the pyrotechnic delay; and a hermetic bushing in contact with the tubular end-stop hermetically closing the tubular pyrotechnic chamber, the hermetic bushing comprising two electrical contacts to provide an electric current to activate the igniter.

11. The safety lighter as claimed in claim 10, wherein the igniter, the pyrotechnic delay and an intermediate lighting relay are positioned in a closed volume comprising the tubular pyrotechnic chamber, the hermetic bushing, the cap and the lighter body, by a second o-ring seal, and a third o-ring seal, wherein:

the first o-ring seal is situated in a circular groove that extends around the second cylindrical end;

the second o-ring seal is situated in a circular groove that extends around the tubular pyrotechnic chamber in contact with the lighter body; and the third o-ring seal is situated in a circular groove that extends around the hermetic bushing.

12. The safety lighter as claimed in claim 1, wherein the cylindrical void of the lighter body comprises:

a first cylindrical area having a diameter D1 approximately equal to a diameter of the tubular pyrotechnic chamber enabling the pyrotechnic slide-in module to slide inside the lighter body; and a second cylindrical area having a diameter D2 approximately equal to a diameter of the second end of the cap, wherein the second cylindrical area is connected to the first cylindrical area by a shoulder of the lighter body.

13. The safety lighter as claimed in claim 1, wherein the retaining mechanism to maintain the pyrotechnic slide-in module in the safety position (Ps) comprises a shearable pin joined at a first end to the lighter body and at a second end to the pyrotechnic slide-in module.

14. The safety lighter as claimed in claim 1, wherein the igniter is an electrically-controlled igniter.

* * * * *